US007633401B1

(12) United States Patent
Copley et al.

(10) Patent No.: US 7,633,401 B1
(45) Date of Patent: Dec. 15, 2009

(54) SELF-DIAGNOSTIC SYSTEM FOR RECLINER AND LIFT-CHAIR MANUAL CONTROLLERS

(75) Inventors: Charles J. Copley, Clarks Summit, PA (US); W. Edward Pollard, Falls, PA (US)

(73) Assignee: Golden Technologies, Inc., Old Forge, PA (US)

( * ) Notice: Subject to any disclaimer, the term of this patent is extended or adjusted under 35 U.S.C. 154(b) by 94 days.

(21) Appl. No.: 11/259,639

(22) Filed: Oct. 26, 2005

Related U.S. Application Data

(60) Provisional application No. 60/622,334, filed on Oct. 26, 2004.

(51) Int. Cl.
*G08B 21/00* (2006.01)

(52) U.S. Cl. ..... 340/664; 340/657; 340/687; 340/691.1; 601/26; 297/330; 297/260.2

(58) Field of Classification Search ..... 340/657, 340/663, 687, 691.1; 5/83.1
See application file for complete search history.

(56) References Cited

U.S. PATENT DOCUMENTS 3,809,985 A * 5/1974 Krause et al. ..... 318/490
3,939,456 A * 2/1976 Curtis et al. ..... 340/519
4,739,326 A * 4/1988 Anderson et al. ..... 340/945
5,179,328 A * 1/1993 Furuse et al. ..... 318/603
5,267,778 A * 12/1993 Krebs et al. ..... 297/330
5,600,300 A * 2/1997 Povilaitis ..... 340/438
5,715,548 A * 2/1998 Weismiller et al. ..... 5/624
6,279,183 B1 * 8/2001 Kummer et al. ..... 5/600
6,400,277 B2 * 6/2002 Guedes ..... 340/646
7,090,297 B2 * 8/2006 Mohn et al. ..... 297/330

* cited by examiner

*Primary Examiner*—Daniel Wu
*Assistant Examiner*—Son M Tang
(74) *Attorney, Agent, or Firm*—Charles A. Wilkinson; Clinton H. Wilkinson

(57) ABSTRACT

A diagnostic system for use in the electronic control circuit for motor actuated lift and/or recline mechanisms for chair wherein a hand controller is used to operate said lift and/or recline mechanisms, and wherein a series of LED indicators are situated at strategic locations in the circuit. The LED indicators can be used to determine whether electricity is flowing to such points in the circuit, which in turn will enable possible problems that might cause the hand control device not to work properly to be quickly more easily pinpointed by immediately narrowing the potential sources or causes of the problem.

17 Claims, 3 Drawing Sheets

SELF-DIAGNOSTIC SYSTEM FOR RECLINER AND LIFT-CHAIR MANUAL CONTROLLERS

CROSS-REFERENCE TO PREVIOUS RELATED APPLICATION

This invention claims priority from U.S. Provisional Patent Application Ser. No. 60/622,334 filed on Oct. 26, 2004, the complete disclosure of which is incorporated herein by reference.

BACKGROUND OF THE INVENTION

1. Field of the Invention

The present invention is directly to control devices in general, and more particularly to a self-diagnostic manual control device for operating a recliner and lift-chair.

2. Preliminary Discussion

Reclining chairs having at least one actuator or motor for moving the recliner between a completely upright position, a variety of partially reclined positions, and a fully reclined position are increasing in number and popularity, mostly due to the lifestyle of the average consumer, wherein an inordinate amount of time is spent in a resting or reclined position, a substantial amount of which time is taken up watching television. Another type of chair having increased use is the lift chair, wherein an actuator or motor is used to operate a lift mechanism which lifts the chair upwardly and tilts it forwardly, to assist an elderly or disabled person sitting in the chair into a standing position, are also becoming increasingly commonplace. Combination lift and recliner chairs are also quite common. The motors or actuators are normally operated using a manual or hand control, typically a handheld device that is hardwired to the motor or motors attached to the chair frame for activating the lift and/or reclining mechanisms of the chair. The hand control usually includes several buttons which when pressed will move or tilt the chair, chair back, and foot rest into a desired reclining position, or raise and lower the lift mechanism, depending upon the nature of the chair.

While such electronic hand controllers make motor actuated lift chairs and recliners very simple to operate and therefore more desirable, particularly for those who do not have the strength or dexterity to operate a manual lift or recliner mechanism, when the hand control does not operate correctly, most consumers have a difficult time determining what is causing such inoperativeness. As a result, the standard response is to immediately contact a service representative. Prior to making a service call, which is expensive and time consuming for the service company, the service representative typically will try to diagnose the problem over the telephone by gathering as much information as he or she can about the problem. However, most users can only supply the service representative with a very minimal amount of information, other than to complain that the controller or chair is not working properly. The frail condition of many of such users, particularly with respect to lift chairs, further limits their ability to self-diagnose the problem, particularly if the individual using the chair lives alone or has minimal assistance from others, and would find it difficult if not impossible to check the wire connections or the like of the entire control circuit. For example, an elderly person may not be able to bend down to inspect the wires, or may have a reduced vision condition that would prevent a detailed inspection of the wires in any event.

While most users of such motor actuated chairs are therefore substantially unable to diagnose a non-working controller, in each case there are several typical problems that might cause the hand controller not to work, which cases together comprise the vast majority of service call situations. First, there may not be any power or current being supplied from the wall receptacle to the chair and motor. This could be caused by a power outage, a tripped breaker, a short in the receptacle or outlet, or even simply by the plug becoming loose or disconnected from the outlet. As indicated above, It is a difficult chore for many disabled individuals to diagnose such problems, even to check whether a plug has pulled out of a wall electrical socket, particularly since the plug many times located behind the chair itself. Another possible cause of an inoperable hand controller is a problem with the motor that activates the recline and/or lift mechanism. Yet another possible problem is that the motor and power supply may be operating correctly, but there may be a malfunction in the hand controller itself, such as a broken button or the like. Very often, a technician on a service call will arrive at a home and find that the problem is simply that the plug for the motor was accidentally disconnected from the wall, or that the cord connecting the controller to the motor became disconnected. As indicated above, while such problems are very easy to fix, the service call itself is invariably very expensive and time consuming, and a large percentage of such service calls could be eliminated if such simple problems could be diagnosed via the telephone, or by the user him or herself.

Recognizing the need for a more efficient system for diagnosing problems occurring in the hand control circuit, the present inventor has developed a system that allows such problems to be considered and diagnosed over the phone, or by the user him or herself, so that the cause of the problem can be pinpointed quickly and easily, and then often solved without the need for a service representative or technician to visit the premises. Furthermore, by use of the system of the invention, even if a serviceman still must make a house call, he or she may from the information provided by the chair user or his or her care provider may better prepare for the particular problems such as by bringing the proper repair parts or the like.

The system is comprised of a series of LED indicators situated at strategic locations in the electronic control circuit for the lift and/or recline mechanisms of a chair using a manual controller. Such lights will indicate basically whether electricity is flowing to such points in the circuit, which in turn will enable possible problems that might cause the hand control device not to work properly to be quickly more easily pinpointed by immediately narrowing the potential sources or causes of the problem.

OBJECTS OF THE INVENTION

It is therefore a primary object of the present invention to provide a system for diagnosing problems with the control circuit for a lift and/or recliner chair actuated by a motor.

It is another object of the present invention to provide a system for more quickly pinpointing causes for an inoperable lift and/or recliner mechanism by immediately eliminating potential causes.

It is a further object of the present invention to provide a motor actuated lift and/or recliner chair having LED indicators strategically placed in the electrical circuit, said LED indicators for enabling a quick determination whether or not electricity is passing through said point in the circuit.

It is a still further object of the present invention to provide a system for diagnosing possible causes for an inoperable motor actuated lift mechanism or reline mechanism, thereby reducing the number of service calls made and the number of service visits a serviceman must make.

It is a still further object of the present invention to provide a system for diagnosing possible causes for an inoperable motor actuated lift mechanism or reline mechanism, making service calls less time-consuming and efficient.

Still other objects and advantages of the invention will become clear upon review of the following detailed description in conjunction with the appended drawings.

SUMMARY OF THE INVENTION

A system for more quickly pinpointing and diagnosing possible causes for an inoperable motor actuated lift mechanism or recline mechanism in a chair is provided. The system enables such problems to be more thoroughly considered and diagnosed by the user without the aid of a service technician. In addition, if a service call is made, a telephone representative can gather more information about the system, and can possibly pinpoint and fix the problem over the phone without the need for a service representative or technician to visit the premises. Furthermore, by using the system of the invention, even if a serviceman still must make a house call, he or she may, from the information provided by the chair user or his or her care provider, better prepare for the particular problems, such as by bringing the proper repair parts or the like.

The system is comprised of a series of LED indicators situated at strategic locations in the electronic control circuit for the lift and/or recline mechanisms of a chair using a manual controller. Such LED indicator lights will indicate whether electricity is flowing to such points in the circuit, which in turn will enable possible problems that might cause the hand control device not to work properly to be more quickly and easily pinpointed by immediately narrowing the potential sources or causes of the problem.

DESCRIPTION OF THE DRAWINGS

FIG. 4*a* illustrates another view of the invention.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
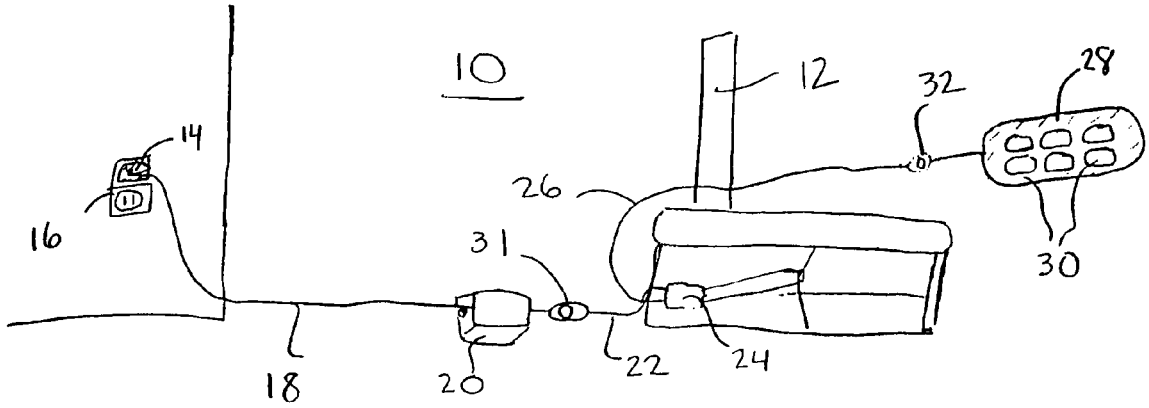
FIG. 1 illustrates a first embodiment of the present invention.

Referring now to FIG. 1, there is shown a first embodiment of the self-diagnostic system 10 of the invention connected to recliner chair 12. Plug 14 is connected to power cord 18 and is electrically connected in receptacle 16. The other end of power cord 18 is electrically connected to transformer 20. A second cord 22 connects between transformer 20 and motor 24 attached to chair 12, while another cord 26 is operably connected between motor 24 and hand control 28. The hand control 28 typically will have several buttons 30 for initiating a particular operation or combination of operations, depending upon the type of chair, such as to raise or lower the lift mechanism if the chair is a lift chair, or to raise and lower the footrest, to move the chair frame between a reclined and upright position, and to raise and lower the chair back if the chair is a recliner. It will be understood of course that the number of buttons and their operation is dependent upon the nature of the chair the combination of possible movements of such chair. It is also possible for the diagnostic system of the present invention, described below, to be used with other arrangements in addition to a recline or lift chair, such as, for example, an adjustable bed wherein various portions of the bed may be raised or lowered depending upon the comfort and needs of the user.

The diagnostic system incorporated into the above-discussed actuator arrangement will now be explained. Referring still to the embodiment shown in FIG. 1, a first LED light 31 is provided in cord 22 between transformer 20 and motor 24, and a second LED light 32 is provided in cord 26 extending between motor 24 and hand control 28. Each of such LED lights 31 and 32, which are preferably green, will be turned on when there is a flow of electrical current passing through such point in the control system. These lights can therefore be referred to and used by a service representative upon receiving a call from a consumer whose hand control 28 is not working, or, alternatively, the lights may be referred to by the user or another who wishes to self-diagnose the problem.

For example, if plug 14 is plugged into receptacle 16, but LED light 31 is not lighted, this is indicative of the fact that there is either no current is being passed from power cord 18 to transformer 20, or that transformer 20 is not working correctly and passing current along cord 22 past LED light 31 to motor 24. Thus, the most likely source of the problem can be immediately narrowed down. In this scenario, LED light 32 should also be turned off, since of course if current is not flowing through LED light 31 in cord 22, the way the circuit is connected it also should not be flowing past LED light 32 in cord 26. In such case, a telephone service representative or other technician can immediately narrow down the possible problems to one or two. In addition, the user may also be able to self-diagnose such problem, and before calling a service representative check to make sure that plug 14 is snugly connected in outlet 16 before reporting a problem most likely with power to transformer 20.

In another possible scenario, LED light 31 may be lighted or turned on, while LED light 32 is not on or turned off. This will be indicative of the fact that while power and current is passing through transformer 20 and presumably reaching motor 24, such current is not reaching hand control 28. Therefore, a logical user understanding the diagnostic system will immediately check to make sure the connection between cord 26 and motor 24, which is usually a type of male/female plug connection, is not loose or has become disconnected, or that cord 22 has not pulled out of motor 24. In such scenario, a user would not initially suspect that the motor itself has failed, since the LED light 32 is indicating that power is not reaching hand control 28, while LED light 31 indicates power is reaching motor 24. However, without such LED lights, the number of possible problems has not been reduced, and cannot be accurately diagnosed without performing a series of tests to determine what portions of the control circuit are still operational.

In a third scenario, both LED light 31 and 32 are lighted or turned on, yet the hand control 28 still will not activate motor 24. In such case, there are two possible problems; either motor 24 has malfunctioned, or hand control 28 has malfunctioned. The user can check the connection between cord 26 and hand control 28; if this is secure, a service technician will likely have to check to see if the problem is with motor 24 and controller 28. However, even in such circumstance the possible causes for the recline or lift mechanisms not working are significantly reduced, therefore reducing the amount of time that a service technician must spend on each service call.

Figure 2:
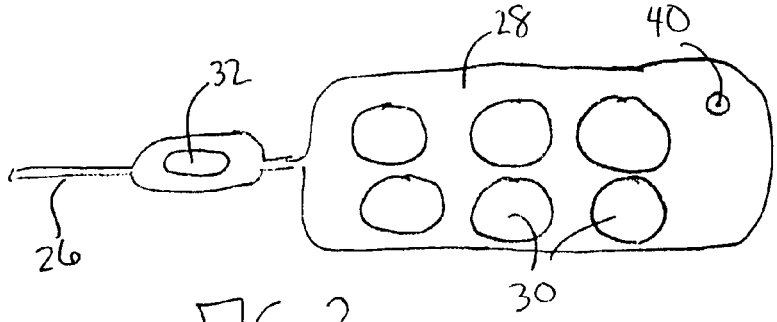
FIG. 2 illustrate a second embodiment of the invention.

In an alternative embodiment, shown in FIG. 2, a third LED light 40 may be provided either connected to motor 24 or (as in FIG. 2) situated on hand control 28. Such third LED light 40 will light or turn on when a signal is created indicating whether when one of the buttons 30 on hand control 28 is depressed, a current or signal is passed to the motor, and therefore will be indicative of the fact that such signal has actually being generated and sent to and received by motor 24. If such LED light 40 indicates that a signal is being sent to or received by motor 24, one can assume that hand control 28 is operative, and the problem is with motor 24 itself. On the other hand, if such LED light 40 indicates a signal is not being generated, it is more likely that the problem is with the hand control and not motor 24.

While the invention has been described using LED lights as the means for determining or indicating whether or not current is passing through the respective points in the control circuit, other indicator means, such as a buzzer, vibrating means, or other light means may also be used in place of such LED lights while still conforming to the objectives and spirit of the invention. In addition, in another embodiment, a central box or station may be provided so that all of such lights are housed in a single location, whereby the user can more easily and quickly make a preliminary determination as to the most likely causes for a malfunction or the like should the hand control suddenly cease to operate simply by reviewing the LED lights or other signaling means which are all situated in such box rather than on or adjacent the various cords of the control system. In a further refinement an electronic means for reading the indications of the indicator system of the invention and sending such information directly over the telephone could be devised. In a still further variation of the system, using a single or multiple closely spaced indicator lights the lights may be differently colored to aid the user of the chair to describe what the indications are over the phone to a repair or service station. The indicator means may also be placed at different strategic points in the circuit where desired. For example, where transformer 20 is not required, LED light 31 would simply be placed in power chord 18. In addition, should there be a battery backup arrangement as part of the control circuit, such battery pack may also include a power indicating means.

Figure 3:
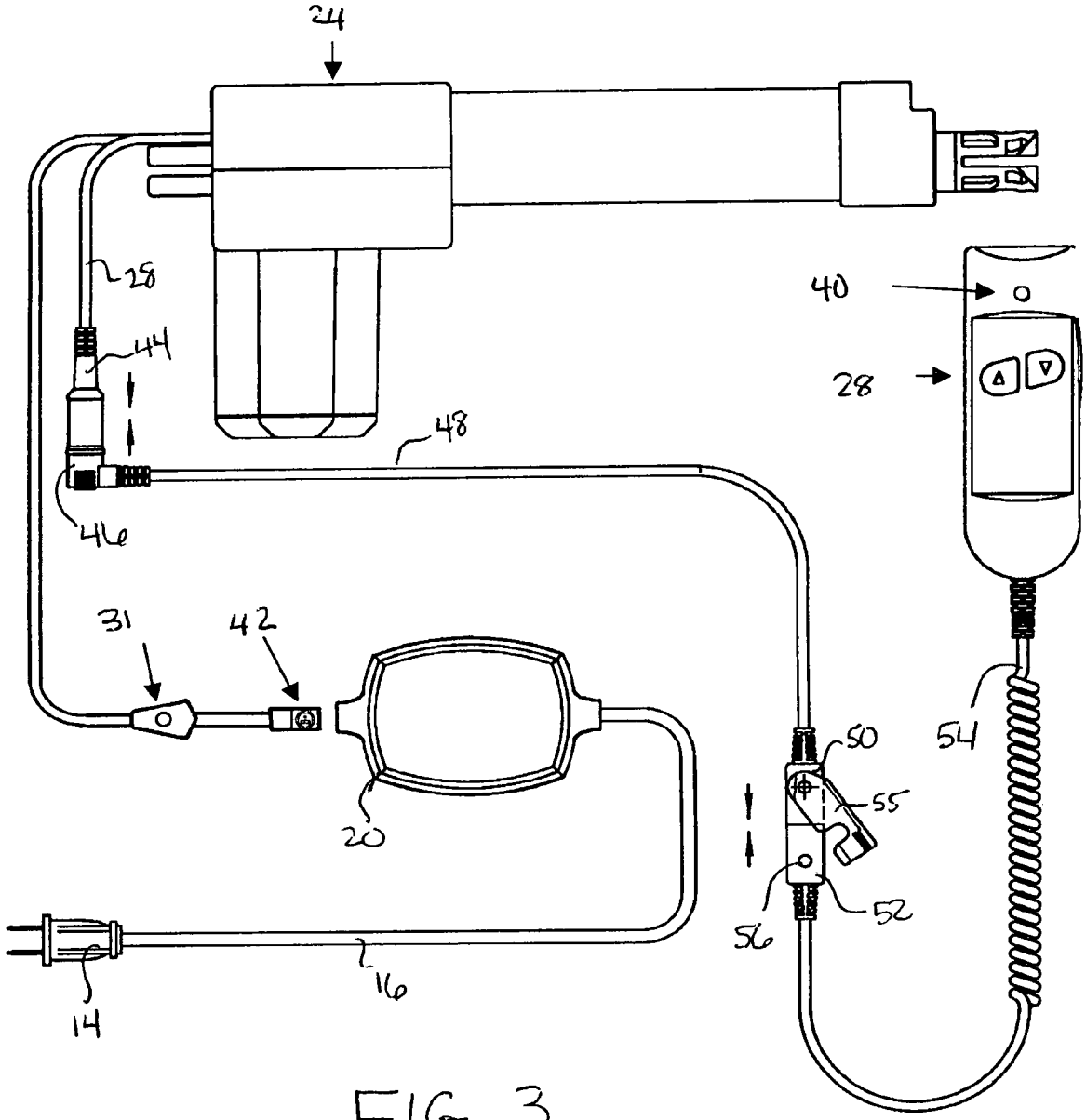
FIG. 3 illustrates a third embodiment of the invention.
Figure 4:
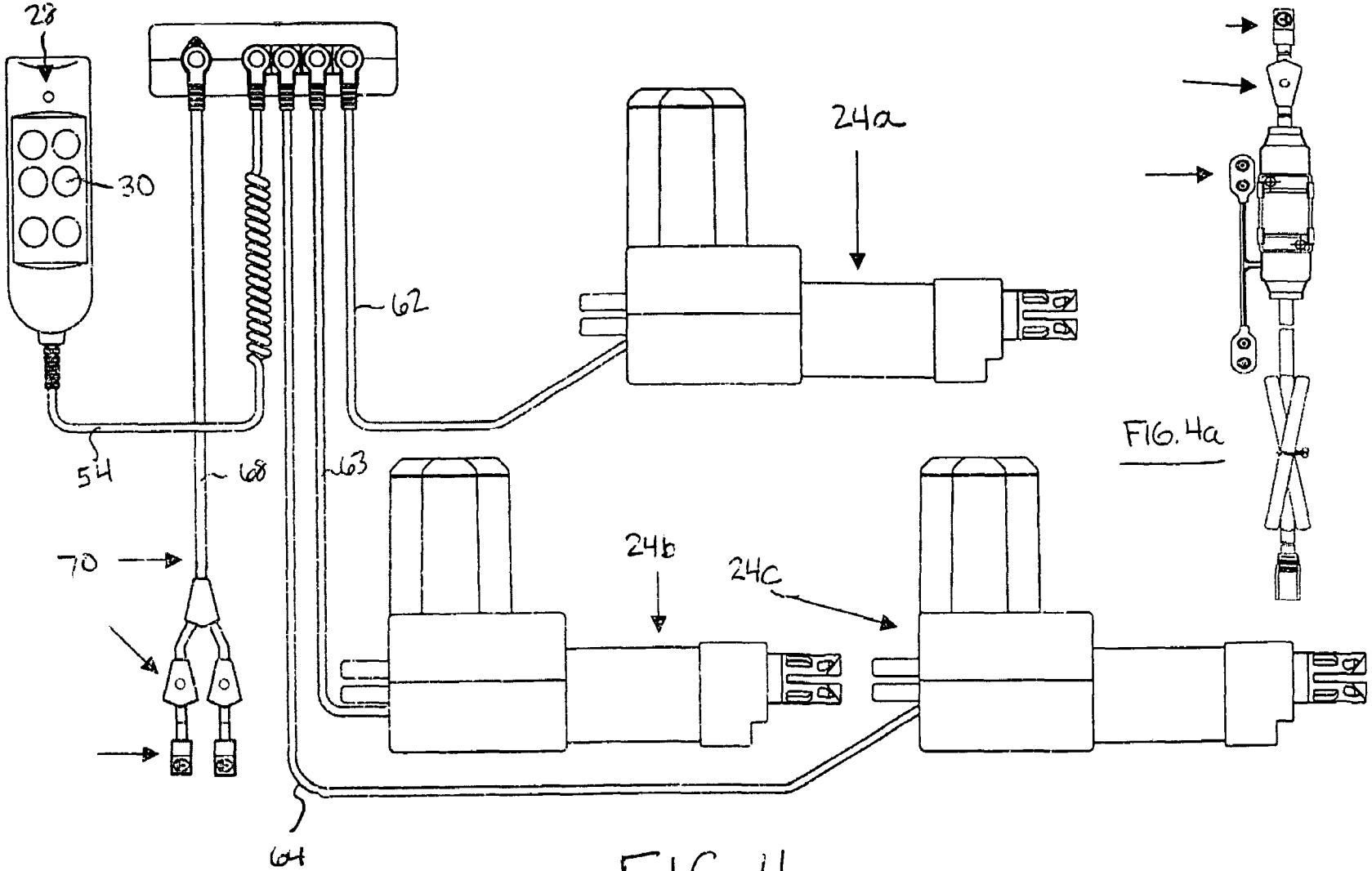
FIG. 4 illustrates a fourth embodiment of the invention.

FIGS. 3 and 4 illustrate two other possible arrangements utilizing an LED light diagnostic such as has just been described. Wherever possible, the same reference numerals used in FIGS. 1 and 2 have been used. A right angle plug 42 detachably connects cord 22 to transformer 20, while motor 26 is not connected to chair 12 as shown in FIG. 1. Cord 26 in FIG. 1 has been replaced with short cord 28 extending from motor 24, and has a female receptacle 44 on its end, to which another right angle plug 46 attached to the end of extension cord 48 is connected. Receptacle 50 is provided on the opposite end of extension cord 48, and plug 52 attached to one end of cord 54 is inserted in receptacle 50. Meanwhile, the opposite end of cord 54 is attached to hand control 28. Receptacle 50 also includes a hook 55 that attached around tab 56 on plug 52 to hold such electrical connection.

FIG. 4 illustrates another alternative embodiment wherein hand control 28 is operably connected to three motors; back motor 24*a*, and dual chair motors 24*b* and 24*c*, rather than a single motor as in the previous embodiments. In such arrangement, cord 54 is connected to a control box 60, cord 62 connects motor 24*a* to control box 60, cord 63 connects motor 24*b* to control box 60, and cord 63 connects motor 24*c* to control box 60. Thus, depending upon which button 30 on hand control 28 is pressed, motors 24*a*, 24*b*, or 24*c* will be activated and adjust the chair accordingly. Cord 68 having a Y-connector 70 on its outer end is also attached to control box 60, and LED lights 71 and 72 are provided on branches 73 and 74 of Y-connector. Right angle plugs 75 and 76 are then provided on the ends of branches 73 and 74, and connect to transformers 20 (not shown) and ultimately to an electrical supply. Another slightly alternative arrangement is shown in FIG. 4*a*.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

The invention claimed is:

1. A system for pre-diagnosing nonoperating conditions in power chair lift and recline mechanism electrical circuits having a plurality of operating components, said operating components being at least one motor connected to said lift or recline mechanism, a transformer electrically connected between said motor and a wall plug, and a hand control device electrically connected to said at least one motor, said operating components interconnected by power cords, and at least two indicator lights connected in series with and on either side of said operating components at preselected points in the circuit for detecting electrical current passing through said preselected points, with a first indicator light positioned between the transformer and motor, and a second indicator light positioned between the motor and hand controller, whereby the status of said indicator lights is analyzed and interpreted together to identify by process of elimination possible causes for said inoperable condition.

2. A system for pre-diagnosing nonoperating conditions in power chair lift and recline mechanism electrical circuits according to claim 1 additionally comprising a third indicator light incorporated into the hand control device to indicate whether a signal is being generated by such hand control device when operated.

3. A system for pre-diagnosing nonoperating conditions in power chair lift and recline mechanism electrical circuits according to claim 2 wherein if said first indicator light is activated and said second indicator light is activated, but said third indicator light is not activated, this is indicative of power reaching the transformer and hand control device, but the hand control device is not working properly.

4. A system for pre-diagnosing nonoperating conditions in power chair lift and recline mechanism electrical circuits according to claim 1 additionally comprising a control box to which the hand control device and two or more motors are operably connected.

5. A system for pre-diagnosing nonoperating conditions in power chair lift and recline mechanism electrical circuits according to claim 1 wherein if said first indicator light is activated and said second indicator light is not activated, this is indicative of power reaching the transformer, but not the hand control device.

6. A system for pre-diagnosing nonoperating conditions in power chair lift and recline mechanism electrical circuits according to claim 1 wherein if said first indicator light is activated and said second indicator light is activated, but said motor-is inoperable, by process of elimination either said motor or said hand control device is likely defective.

7. A power actuated chair including a system for quickly identifying possible sources of a malfunction comprising:

at least one motor operably connected to a chair assembly linkage mechanism for moving said chair assembly between a range of possible positions, a transformer operably connectable to the motor by a first conductor cable and to a receptacle for providing electrical power to the system by a second conductor cable, a hand control device operably connected to said motor by a third conductor cable for activating the motor to adjust the position of the chair assembly between different reclined, upright, and lift positions, a first sensor positioned on said transformer or in said first conductor cable for sensing and indicating the presence of an electric current at the location of said first sensor, a second sensor positioned between said hand control and motor or in said third conductor cable for sensing and indicating the presence of an electric current passing through said second sensor, said first and second sensors each connected to separate LED lights for visually indicating the presence of an electric current at the location of said sensors, and whereby by reference to activation of said first and second sensors and one or more inoperative parts of the chair assembly and its associated components, a preliminary malfunction diagnosis can be made.

8. The system of claim 7 wherein if an electrical current is not sensed by said first sensor, this is indicative of either a malfunction in said transformer or a lack of current reaching said transformer.

9. The system of claim 7 additionally comprising at least two motors.

10. The system of claim 9 additionally comprising a control box to which the hand control, motors, transformers and any other chair features and components are operably connectable.

11. The system of claim 7 additionally comprising at least three motors.

12. The system of claim 7 additionally comprising an indicator on said hand control for indicating whether a signal is being generated by said hand control when operated.

13. A method of reducing a number of service calls by pre-diagnosing possible causes for an inoperative condition of a power operated chair from a remote location, said power operated chair having a linkage assembly for moving at least one of the seat, back, and leg rest portions of the chair between a range of possible positions, at least one motor operably connected to said linkage assembly, a transformer operably positioned between said motor and an electrical plug, a hand control device operably connected to said motor, a first current sensor positioned between said transformer and motor, and a second current sensor positioned between said hand control and motor, said sensors being operably connected to first and second LED lights, respectively which are turned on when an electrical current passes through said sensors, comprising the steps of:

(a) receiving a service inquiry from a user;

(b) instructing the user to visually determine if the first LED light is turned on;

(c) instructing the user to visually determine if the second LED light is turned on; and (d) making a preliminary determination as to the possible reasons for said inoperative condition.

14. The method of claim 13 wherein prior to completing step (d), if said first LED light is turned off, comprising the additional step of:

(e) instructing the user to check whether or not the plug is properly connected to an electrical outlet, whereby if said plug is not properly connected, instructing the user to properly connect said plug and then repeating steps (b) and (c), but if said plug is properly connected making a preliminary diagnosis that either current is not being properly passed to said transformer, or said transformer is not working properly.

15. The method of claim 13 wherein prior to completing step (d), if said first LED light is turned on, but said second LED light is turned off, comprising the additional step of:

(f) instructing the user to check that the connection between the transformer and motor is secure, whereby if said connection is not secure instructing the user to secure said connection and then repeat steps (b) and (c), but if said connect is secure dispatching a service representative to perform further testing on said chair.

16. The method of claim 13 wherein prior to completing step (d), if said first and second LED lights are turned on but said hand control in inoperative, comprising the additional step of:

(g) instructing the user to check that the connection between the motor and hand control is secure, whereby if said connection is not secure instructing the user to secure said connection and then repeat steps (b) and (c), but if said connection is secure dispatching a service representative to perform further testing on said chair.

17. The method of claim 13 in which a third current sensor and LED light are provided on said hand control, which LED light will turn on when any of the buttons on the hand control is manually pressed to pass a signal to said motor, comprising the additional step of:

(h) instructing the user to depress one of the buttons on the hand control and determine whether the third LED light turns on, whereby if said third LED does turn on, determining that said motor is a likely cause of said inoperative condition, but if said third LED light does not turn on, determining that said hand control is a likely cause of said inoperative condition.

* * * * *